US005718007A

United States Patent [19]

Loyd

[11] Patent Number: 5,718,007

[45] Date of Patent: Feb. 17, 1998

[54] PORTABLE SPA WITH EASY ACCESS MAINTENANCE TRAY

[76] Inventor: Casey Loyd, 4722 W. Mission Blvd., Ontario, Calif. 91762

[21] Appl. No.: 645,818

[22] Filed: May 14, 1996

[51] Int. Cl.[6] ..... A47K 3/00

[52] U.S. Cl. ..... 4/541.1; 4/545; 4/546; 4/559

[58] Field of Search ..... 4/541.1, 541.2, 4/541.3, 541.4, 541.5, 541.6, 545, 546, 548, 549, 559, 584, 506, 509, 496, 494, 557, 489, 493, 508

[56] References Cited

U.S. PATENT DOCUMENTS

| | | | |
|---|---|---|---|
| 4,679,545 | 7/1987 | Cavestany | 4/493 |
| 4,942,630 | 7/1990 | Kantor et al. | 4/541.2 |
| 5,459,887 | 10/1995 | Roman et al. | 4/541.4 |
| 5,515,557 | 5/1996 | Spurlin | 4/541.1 |

*Primary Examiner*—David J. Walczak

*Attorney, Agent, or Firm*—Sheldon & Mak; Denton L. Anderson

[57] ABSTRACT

A spa is provided wherein fluid circulation equipment is disposed on a movable tray to facilitate maintenance work on such fluid circulation equipment.

15 Claims, 2 Drawing Sheets

PORTABLE SPA WITH EASY ACCESS MAINTENANCE TRAY

FIELD OF THE INVENTION

This invention relates generally to portable spas and hot tubs, and particularly to portable spas and hot tubs having water and air circulation equipment.

BACKGROUND OF THE INVENTION

Portable spas and hot tubs have become enormously popular in the United States. The relative small size of such devices (compared to traditional swimming pools) allows the devices to be inexpensively manufactured, assembled and installed. It also allows for inexpensive heating and, in most devices, the introduction of bubbled air.

One of the advantages of such devices is their relatively small "footprint," which facilitates the installation of the device within a relatively confined space. To reduce the footprint of the device to an absolutely minimum, most manufacturers dispose the necessary water and air circulation equipment (usually including a water pump, pump motor, water heater and air blower) within the skirt which typically forms the external walls of the device.

The problem with placing such circulation equipment within the confines of the skirt is that it makes maintenance on the circulation equipment somewhat difficult.

Accordingly, there is a need for a spa wherein maintenance on fluid circulation equipment is facilitated by granting easy access to such equipment.

SUMMARY OF THE INVENTION

The invention satisfies this need.

The invention is a portable spa having a spa tub and one or more of the following items of fluid circulation equipment: a water pump, a pump motor, a water heater or an air blower. At least one item of such fluid circulation equipment is mounted on a moveable tray which is movable between (1) a first tray position wherein the item or items of fluid circulation equipment are disposed proximate to the spa tub, and (2) a second tray position wherein the item or items of fluid circulation equipment are disposed distal to the spa tub.

In a typical embodiment, the moveable tray is disposed under the uppermost lip of the spa tub and, in the first tray position, is disposed behind an access door or panel within the confines of a spa skirt.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
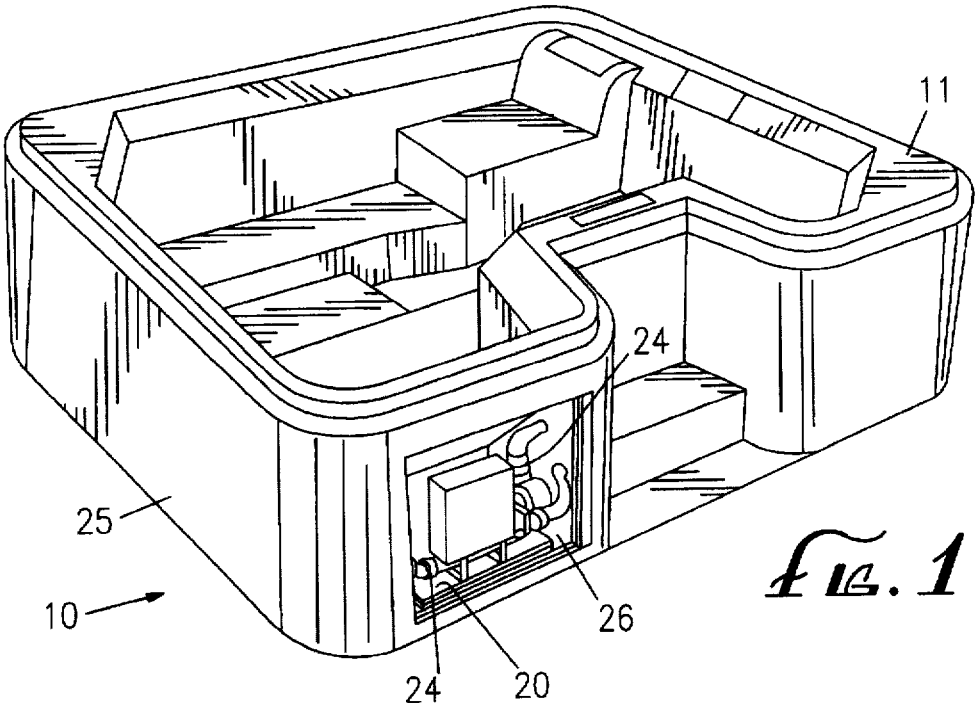
FIG. 1 is a perspective view of a portable spa having features of the invention.
Figure 2:
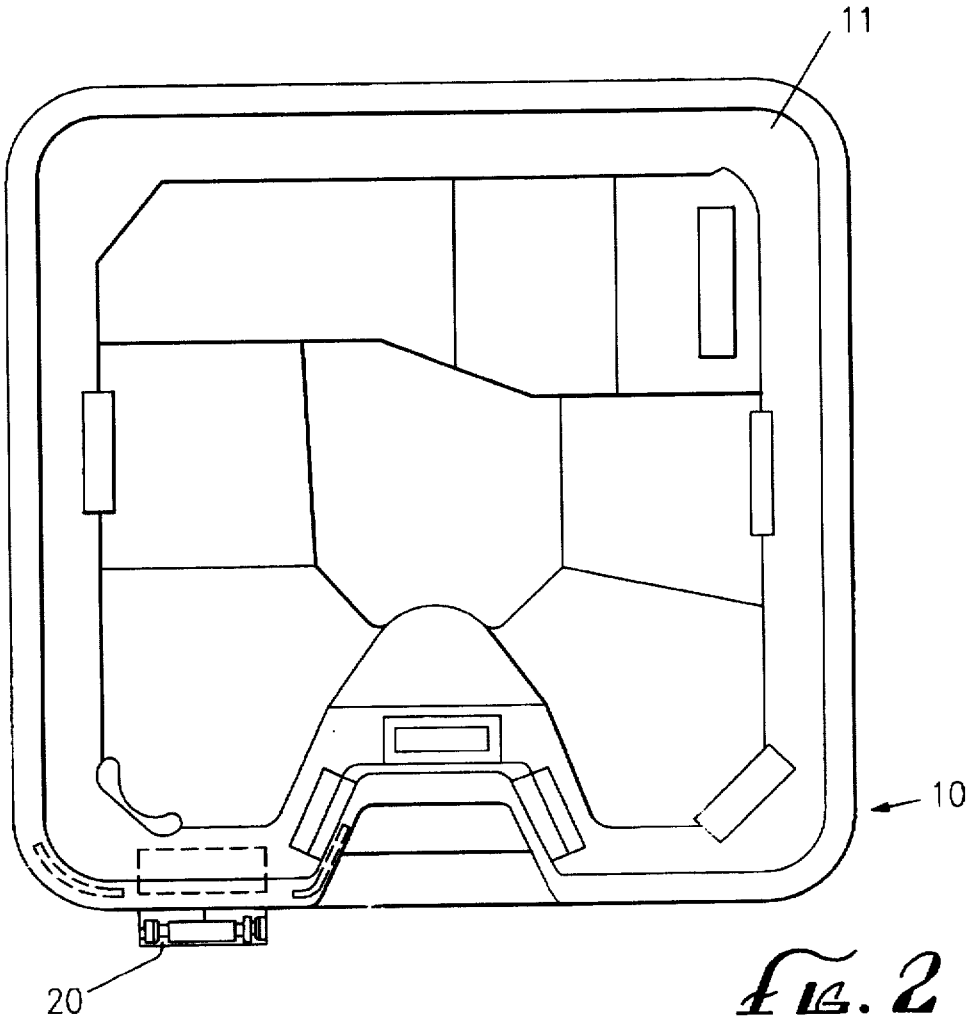
FIG. 2 is a top view of the portable spa of FIG. 1.
Figure 3:
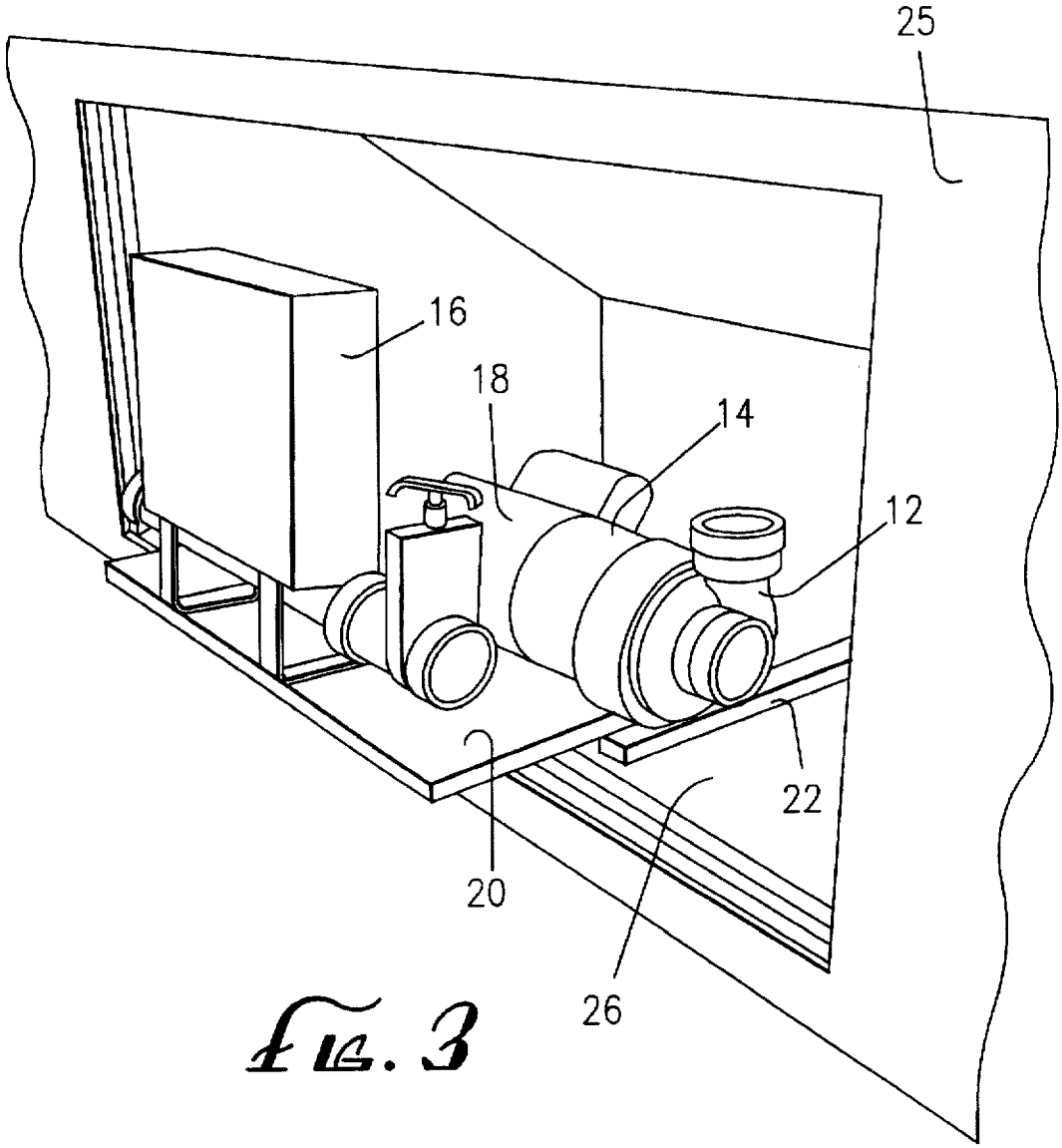
FIG. 3 is a perspective detailed view of fluid circulation equipment mounted on a moveable tray having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a spa 10 having a spa tub 11 and one or more of the following items of fluid circulation equipment: a water pump 12, a water pump motor 14, a water heater 16 and an air blower 18. Typically, one or more of the items of fluid circulation equipment are disposed substantially under the spa tub 11 when the tray is in the first spa position. In the invention, at least one item of the fluid circulation equipment is mounted on a movable tray 20 which is movable between (1) a first tray position wherein at least one of the items of fluid circulation equipment is disposed proximate to the spa tub 11, and (2) a second tray position wherein at least one item of fluid circulation equipment is disposed distal to the spa tub 11.

The tray 20 can be made movable by any of the enumerable movable tray mounting means known in the arts. In a typical embodiment, the tray 20 is supported on opposite sides by support arms 22 which may or may not be themselves outwardly movable as the tray 20 is moved from the first tray position to the second tray position.

The tray 20 can be made of wood, plastic or other suitable material. In a typical embodiment, the tray is made from steel.

Typically, the width of the tray 20 is between about one foot and about four foot and the depth of the tray 20 is between about 6 inches and about 3 feet.

In a typical embodiment, the items of fluid circulation equipment are, under normal operating conditions, connected in fluid-tight communication with various water or air circulation conduits necessary in the operation of the spa. In the spas of the invention, such connections are accomplished with pipe unions 24 or other easily disconnected and reconnected connection means.

The invention is ideal for disposing the fluid circulation equipment in close proximity to the spa tub 11, typically in many cases less than 6 inches away from the spa tub 11. By using the tray 20 of the invention, the fluid circulation equipment can be moved away from the spa tub 11 to a distance 1 foot away or greater for ease of maintenance of the fluid circulation equipment.

In a typical embodiment, the perimeter of the spa tub 11 is surrounded by a skirt 25 and the movable tray 20 is disposed between the spa tub 11 and the skirt 25. The tray 20 is moved from the first tray position to the second tray position through a maintenance opening 26 disposed in the skirt 25. Such maintenance opening 26 is generally at least about 3 square feet in area.

The invention provides an easy and inexpensive way to facilitate maintenance on portable spa fluid circulation equipment. The invention is inexpensive to manufacture and requires no increase to the overall spa footprint.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A spa having a spa tub and one or more of the following items of fluid circulation equipment: a pump, a pump motor, a heat or an air blower;

wherein at least one item of the fluid circulation equipment is mounted on a movable tray affixed to the spa; and wherein the tray is movable, while remaining affixed to the spa, between (1) a first tray position wherein the item of circulation equipment is disposed proximate to the spa tub and (2) a second tray position wherein the mounted item of circulation equipment is disposed distal to the spa tub.

2. The spa of claim 1 wherein, when the tray is in the first tray position, the at least one item of fluid circulation equipment is less than about 6 inches away from the spa tub and, when the tray is in the second tray position, the at least one item of circulation equipment is greater than about 1 foot away from the spa tub.

3. The spa of claim 1 wherein the width of the tray is between about 1 foot and about 4 feet.

4. The spa of claim 1 wherein the depth of the tray is between about 6 inches and about 3 feet.

5. The spa of claim 1 wherein the tray is supported on opposite sides by support arms.

6. The spa of claim 5 wherein the support arms move outwardly away from the spa tub when the tray is moved from the first tray position to the second tray position.

7. The spa of claim 1 wherein the at least one item of circulation equipment is disposed under the spa tub when the tray is in the first spa position.

8. The spa of claim 1 wherein the portable spa further comprises a skirt which circumscribes the spa, wherein the skirt has an equipment maintenance opening of at least about 3 square feet in area, and wherein the tray is movable across the equipment maintenance opening.

9. The spa of claim 1 wherein the spa comprises two or more of the following items of fluid circulation: a pump, a pump motor, a heater and an air blower.

10. The spa of claim 1 wherein the spa comprises the following items of fluid circulation equipment: a pump, a pump motor, a heater and an air blower.

11. A spa having a spa tub and one or more of the following items of fluid circulation equipment: a pump, a pump motor, a heater and an air blower;

wherein at least one item of the fluid circulation equipment is mounted on a movable tray affixed to the spa;

wherein the tray is movable, while remaining affixed to the spa, between (1) a first tray position wherein the item of circulation equipment is disposed proximate to the spa tub and (2) a second tray position wherein the mounted item of circulation equipment is disposed distal to the spa tub;

wherein, when the tray is in the first tray position, the at least one item of water circulation equipment is less than about 6 inches away from the spa tub, and, when the tray is in the second tray position, the at least one item of circulation equipment is greater than about 1 foot away from the spa tub;

wherein the width of the tray is between about 1 foot and about 4 feet;

wherein the depth of the tray is between about 6 inches and about 3 feet;

wherein the tray is supported on opposite sides by support arms; and wherein the spa further comprises a skirt which circumscribes the spa, the skirt has an equipment maintenance opening of at least about 3 square feet in area, and the tray is movable across the equipment maintenance opening.

12. The spa of claim 11 wherein the tray is horizontally moveable between the first tray position and the second tray position.

13. The spa of claim 11 wherein the tray is slidably moveable between the first tray position and the second tray position.

14. The spa of claim 1 wherein the tray is horizontally moveable between the first tray position and the second tray position.

15. The spa of claim 1 wherein the tray is slidably moveable between the first tray position and the second tray position.

* * * * *